US011107600B2

(12) United States Patent
Cohen et al.

(10) Patent No.: US 11,107,600 B2
(45) **Date of Patent: *Aug. 31, 2021**

(54) RARE-EARTH METAL HALIDE SCINTILLATORS WITH REDUCED HYGROSCOPICITY AND METHOD OF MAKING THE SAME

(71) Applicant: Siemens Medical Solutions USA, Inc., Malvern, PA (US)

(72) Inventors: Peter Carl Cohen, Knoxville, TN (US); A. Andrew Carey, Lenoir City, TN (US); Mark S. Andreaco, Knoxville, TN (US); Matthias J. Schmand, Lenoir City, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 427 days.

This patent is subject to a terminal disclaimer.

(21) Appl. No.: 13/646,758

(22) Filed: Oct. 8, 2012

(65) Prior Publication Data

US 2013/0087711 A1 Apr. 11, 2013

Related U.S. Application Data

(60) Provisional application No. 61/545,262, filed on Oct. 10, 2011, provisional application No. 61/545,253, filed on Oct. 10, 2011.

(51) Int. Cl.
*G21K 4/00* (2006.01)

(52) U.S. Cl.
CPC ..... *G21K 4/00* (2013.01)

(58) Field of Classification Search
CPC ..... C30B 29/12; C30B 11/00; C30B 15/00; C09K 11/7772; G01T 1/2023; G01T 1/202; G21K 4/00
USPC ..... 250/361 R, 362, 370.11; 252/301.4 H, 252/301.4 R; 117/73; 423/263
See application file for complete search history.

(56) References Cited

U.S. PATENT DOCUMENTS

| | | | | |
|---|---|---|---|---|
| 4,261,854 | A | 4/1981 | Kotera et al. | |
| 5,140,159 | A | 8/1992 | Blasse | |
| 5,736,069 | A * | 4/1998 | Willems et al. | 252/301.4 H |
| 6,228,286 | B1 | 5/2001 | Leblans et al. | |
| 2002/0177242 | A1* | 11/2002 | Hutchens | B01J 20/281 506/12 |
| 2007/0045650 | A1* | 3/2007 | Hancu | C09K 11/7734 257/100 |
| 2007/0131866 | A1 | 6/2007 | Srivastava et al. | |
| 2008/0067391 | A1 | 3/2008 | Shimizu et al. | |
| 2008/0093557 | A1* | 4/2008 | Cooke et al. | 250/361 R |
| 2008/0131347 | A1* | 6/2008 | Srivastava | C09K 11/7705 423/263 |
| 2009/0001285 | A1 | 1/2009 | Maeda et al. | |
| 2009/0008561 | A1* | 1/2009 | Nagarkar et al. | 250/361 R |
| 2011/0108738 | A1* | 5/2011 | Doty et al. | 250/459.1 |
| 2013/0087712 | A1* | 4/2013 | Szupryczynski et al. | 250/366 |

FOREIGN PATENT DOCUMENTS

| | | | |
|---|---|---|---|
| CN | 1629251 | A | 6/2005 |
| CN | 1847539 | A | 10/2006 |
| CN | 101479361 | A | 7/2009 |
| CN | 101646748 | A | 2/2010 |
| DE | 2951516 | | 7/1980 |
| EP | 0029963 | | 6/1981 |
| EP | 0083071 | | 7/1983 |
| JP | H0476088 | | 3/1992 |
| JP | 4-170501 | * | 6/1992 |
| JP | H07331240 | | 12/1995 |
| JP | 2007205970 | A | 8/2007 |
| JP | 2007232636 | A | 9/2007 |
| JP | 2007327055 | A | 12/2007 |
| JP | 2008101180 | A | 5/2008 |
| JP | 2008175815 | A | 7/2008 |
| JP | 2010522806 | A | 7/2010 |
| JP | 2014534304 | A | 12/2014 |
| JP | 2014534305 | | 12/2014 |
| WO | 2010103917 | A1 | 9/2010 |

OTHER PUBLICATIONS

Shah et al., "LaBr3:Ce Scintillators for Gamma-Ray Spectroscopy," Dec. 6, 2003, IEEE Transactions on Nuclear Science, vol. 50, No. 6, pp. 2410-2413.*

Takashi, "Gamma-ray measurements using an inorganic scintillator", last modified Apr. 3, 2009, http://www-cr.scphys.kyoto-u.ac.jp/gakubu/P6/2007/P6_2007_scinti_report.pdf, in particular p. 29.*

Kozlov, V., 2010, "TlBr raw material purification, crystal growth, annealing, detector fabrication and characterisation for gamma ray detector applications", Dissertation, University of Helsinki.*

Rooh, G. et al., "The growth and scintillation properties of CsCe2Cl7 crystal", 2008, Journal of Crystal Growth 311, pp. 128-131.*

Search Report, PCT/US2012/059286, dated Nov. 29, 2012.

Office Action dated Jul. 28, 2015 in CN Application No. 201280049752.6, 22 pages, English translation attached.

English translation of Office Action dated Aug. 3, 2015 in JP Application No. 2014-535778, 6 pages.

(Continued)

*Primary Examiner* — Blake C Riddick

(57) ABSTRACT

The present disclosure discloses rare earth metal halide scintillators compositions with reduced hygroscopicity. Compositions in specific implementations include three group of elements: Lanthanides, (La, Ce, Lu, Gd or V), elements in group 17 of the periodic table of elements (Cl, Br and I) and elements of group 13 (B, Al, Ga, In, Tl), and any combination of these elements. Examples of methods for making the compositions are also disclosed.

20 Claims, No Drawings

(56) References Cited

OTHER PUBLICATIONS

Translation of Office Action dated Aug. 3, 2015 in JP Application No. 2014-535778, 6 pages.
Office action dated May 9, 2016 in CN Patent Application No. 201280049752.6 (English translation attached) 20 pages.
Aug. 25, 2016 Office Action from DE Patent Application No. 112012004218.2, 5 pages, English translation attached, 5 pages.
Office Action from Corresponding Chinese Appln. No. 201280049752.6 dated Oct. 9, 2018 with English translation.

* cited by examiner

RARE-EARTH METAL HALIDE SCINTILLATORS WITH REDUCED HYGROSCOPICITY AND METHOD OF MAKING THE SAME

CROSS-REFERENCE TO RELATED APPLICATIONS

This application claims the benefit of U.S. Provisional Applications Ser. Nos. 61/545,253 and 61/545,262, both filed Oct. 10, 2011, which provisional applications are incorporated herein by reference.

TECHNICAL FIELD

This disclosure relates to scintillator materials used for detecting ionizing radiation, such as X-rays, gamma rays and thermal neutron radiation, in security, medical imaging, particle physics and other applications. This disclosure relates particularly to rare-earth metal halide scintillator materials. Certain arrangements also relate to specific compositions of such scintillator material, method of making the same and devices with such scintillator materials as components.

BACKGROUND

Scintillator materials, which emit light pulses in response to impinging radiation, such as X-rays, gamma rays and thermal neutron radiation, are used in detectors that have a wide range of applications in medical imaging, particle physics, geological exploration, security and other related areas. Considerations in selecting scintillator materials typically include, but are not limited to, luminosity, decay time, emission wavelengths, and stability of the scintillation material in the intended environment.

While a variety of scintillator materials have been made, there is a continuous need for superior scintillator materials.

DESCRIPTION

Metal Halides, especially rare earth metal halides such as $LaBr_3$, $LaCl_3$, $CeBr_3$, $CeCl_3$ and $LuI_3$, are scintillator compositions known from their good energy resolution and relatively high light output. The main disadvantage of these materials is their extremely high solubility in water. Hygroscopicity is one of the main reasons that slows down the process of commercialization of these compounds. Crystal growth processes, following a multistage purification, zone refining and drying all require very well controlled atmosphere with depleted content of water and oxygen. Moreover, handling and post-growth processing of these materials has to be performed in an ultra-dry environment to avoid degradation of materials. Furthermore, many of these compounds are light sensitive and thus require additional handling steps. In addition, such materials often can be used only in the hermetic package that prevents them from degradation due to the hydration effects. Therefore, it is desirable to improve or develop new scintillator materials with significantly lower solubility in water (i.e., lower hygroscopicity).

This disclosure relates generally to rare-earth metal halide scintillator materials and method of making such scintillator materials. In one arrangement, the rare-earth metal halide scintillator materials have compositions with reduced hygroscopicity. Compositions in specific implementations include three group of elements: Lanthanides, (La, Ce, Lu, Gd or V), elements in group 17 of the periodic table of elements (Cl, Br and I) and elements of group 13 (B, Al, Ga, In, Tl), and any combination of these elements.

A further aspect of the present disclosure relates to a method of making chloride scintillator materials of the above-mentioned compositions. In one example, high-purity starting halides (such as TlBr and $CeBr_3$) are mixed and melted to synthesize a compound of the desired composition of the scintillator material. A single crystal of the scintillator material is then grown from the synthesized compound by the Bridgman method (or Vertical Gradient Freeze (VGF) method), in which a sealed ampoule containing the synthesized compound is transported from a hot zone to a cold zone through a controlled temperature gradient at a controlled speed to form a single-crystalline scintillator from molten synthesized compound.

Another aspect of the present disclosure relates to a method of using a detector comprising one of the scintillation materials described above for imaging.

This disclosure is related to the new compositions of rare earth metal halides where the change in the character of the compounds is achieved by adding of elements from group 13 of Periodic Table of Elements. These elements may create covalent bonds with metal halides that result in their lower hygroscopicity. A good example of group-13 compounds is TlBr, which is known for being insoluble in water. Introduction of Tl into the rare earth metal halides, such as $LaBr_3$ and $CeBr_3$, results in creation of Tl-Br covalent bonds. These bonds change the character of these compounds from being "Hard Acid-Hard Base" to "Soft Acid-Soft Base."

The physical forms of the scintillator substance include, but are not limited to, crystal, polycrystalline, ceramic, powder or any of composite forms of the material.

A reduction in the hygroscopicity is achieved by co-doping and/or changes in the stoichiometry of a scintillator substance. These changes may be achieved by stoichiometric admixture and/or solid solution of compounds containing elements from group-13 periodic table.

One way of the implementation of this innovation is a codoping with one or more group-13 elements in concentrations that do not alter significantly the symmetry of the crystal lattice of the scintillator of choice. Another way includes a complete modification of the crystal structure of the scintillator composition by stoichiometric change or solid solution of scintillator compounds and other compounds containing at least one of group-13 elements. In these cases, new scintillator materials are created with significantly reduced hygroscopicity.

The present disclosure includes, but is not being limited to, the following families of metal halides compositions described by general chemical formulas:

$A'_{(1-x)}B'_xCa_{(1-y)}Eu_yC'_3$ (1), $A'_{3(1-x)}B'_{3x}M'Br_{6(1-y)}Cl_{6y}$ (2), $A'_{(1-x)}B'_xM'_2Br_{7(1-y)}C'_{7y}$ (3), $A'_{(1-x)}B'_xM''_{(1-y)}Eu_yI_3$ (4), $A'_{3(1-x)}B'_{3x}M''_{(1-y)}Eu_yI_5$ (5), $A'_{(1-x)}B'_xM''_{2(1-y)}Eu_{2y}I_5$ (6), $A'_{3(1-x)}B'_{3x}M'_2Cl_7$ (7), $A'_{(1-x)}B'_xM'_2Cl_7$ (8), and $M'_{(1-x)}B'_xC'_3$ (9), wherein:

A'=Li, Na, K, Rb, Cs or any combination thereof,

B'=B, Al, Ga, In, Tl or any combination thereof,

C'=Cl, Br, I or any combination thereof,

M' consist of Ce, Sc, Y, La, Lu, Gd, Pr, Tb, Yb, Nd or any combination thereof,

M" consists of Sr, Ca, Ba or any combination of thereof, $0 \le x \le 1$, and $0 \le y \le 1$.

In a particular, non-limiting, example, thallium (Tl) is introduced into the crystallographic lattice of $LaBr_3$ compound (formula 9). In this specific example, a strong Tl—Br covalent bond (as opposed to ionic bond in $LaBr_3$) is created that significantly reduces the reactivity of the compound with water.

In the higher concentration of Tl it is possible to create scintillator materials with altered crystallographic lattice. That includes also a stoichiometry change in the crystal itself. The strength of Tl—Br bond is demonstrated in TlBr compound that is known from significantly lower hygroscopicity in comparison to the other rare-earth metal halides. The expected changes in solubility can be explained based on the HSAB concept, explained in more detail below.

Moreover, introduction of the elements from group-13 into the crystal structure of rare-earth metal halides often improves scintillation characteristics of these materials. Addition of Tl as a codopant or stoichiometric admixture to certain compositions of rare-earth metal halides creates very efficient scintillation centers. These centers contribute to the scintillation light output.

In addition, using compounds of group-13 elements can favorably increase the density of the material. Improvement in the density is particularly important in radiation detection applications. The new scintillator materials have applications in Positron Emission Tomography (PET), Single Photon Emission Computed Tomography (SPECT), Computerized Tomography (CT), and other applications used in homeland security and well logging industry.

This disclosure also relates to the method of growing scintillator that includes crystallization of the melted or dissolved scintillator compounds under controlled environment.

The changes in solubility of new rare-earth metal halides scintillators disclosed herein may be understood based on HSAB concept.

The HSAB is an acronym for "Hard and Soft Acids and Bases" known also, as the Pearson acid-base concept. This concept attempts to unify inorganic and organic reaction chemistry and can be used to explain in qualitative rather than quantitative way the stability of compounds, reaction mechanisms and pathways. The concept assigns the terms 'hard' or 'soft', and 'acid' or 'base' to variety of chemical species. 'Hard' applies to species which are small based on their Ionic radii, have high charge states (the charge criterion applies mainly to acids, to a lesser extent to bases), and are weakly polarizable. 'Soft' applies to species which are big, have low charge states and are strongly polarizable. Polarizable species can form covalent bonds, whereas non-polarizable form ionic bonds. See, for example, (1) Jolly, W. L., Modern Inorganic Chemistry, New York: McGraw-Hill (1984); and (2) E.-C. Koch, Acid-Base Interactions in Energetic Materials: I. The Hard and Soft Acids and Bases (HSAB) Principle-Insights to Reactivity and Sensitivity of Energetic Materials, Prop., Expl., Pyrotech. 30 2005, 5. Both of the references are incorporated herein by reference.

In the context of this disclosure the HSAB theory helps in understanding the predominant factors which drive chemical properties and reactions. In this case, the qualitative factor is solubility in water. On the one hand, water is a hard acid and hard base combination, so it is compatible with hard acid and bases. Thallium bromide is, on another hand, a soft acid and soft base combination, so it is not soluble in water.

According to the HSAB theory, soft acids react faster and form stronger bonds with soft bases, whereas hard acids react faster and form stronger bonds with hard bases, all other factors being equal.

Hard acids and hard bases tend to have the following characteristics:

small atomic/ionic radius
high oxidation state
low polarlzabllity
high electronegativity (bases)

Examples of hard acids include: $H^+$, light alkali ions (for example, Li through K all have small ionic radius), $Ti^{4+}$, $Cr^{3+}$, $^{Cr6+}$, $BF_3$. Examples of hard bases are: $OH^-$, $F^-$, $Cl^-$, $NH_3$, $CH_3COO^-$ and $CO_3^{2-}$. The affinity of hard acids and hard bases for each other is mainly ionic in nature.

Soft acids and soft bases tend to have the following characteristics:

large atomic/ionic radius
low or zero oxidation state
high polarizability
low electronegativity Examples of soft acids are: $CH_3Hg^+$, $Pt^{2+}$, $Ag^+$, $Au^+$, $Hg^{2+}$, $Hg_2^{2+}$, $Cd^{2+}$, $BH_3$ and group-13 in +1 oxidation state. Examples of soft bases include: $H^-$, $R_3P$, $SCN^-$ and $I^-$. The affinity of soft acids and bases for each other is mainly covalent in nature.

There are also borderline cases identified as borderline acids for example: trimethylborane, sulfur dioxide and ferrous $Fe^{2+}$, cobalt $Co^{2+}$, cesium $Cs^+$ and lead $Pb^{2+}$ cations, and borderline bases such as bromine, nitrate and sulfate anions.

Generally speaking, acids and bases interact and the most stable interactions are hard-hard (ionogenic character) and soft-soft (covalent character).

In the specific case presented as an example compounds such as $LaBr_3$ and TlBr have the following elements to consider following reaction with water: $La^{+3}$, $Br^-$, $Tl^+$, $H^-$, $OH^-$.

$La^{+3}$: This is a strong acid. High positive charge (+3) small ionic radius.

$Br^-$: This is a soft base. Large ionic radius small charge (−1).

$Tl^+$: This is a soft acid. Low charge and large ionic radius.

$H^+$: This is a hard acid. Low ionic radius and high charge density.

$OH^-$: This is a hard base. Low charge, small ionic radius.

Thus the reaction of $LaBr_3$ and water takes place in according to the following scheme:

$$[La^{+3},Br^-]+[H^+, OH^-]\rightarrow[La^{+3}, OH^-]+[H^+, Br].$$

The left hand side of the equation has two components that are being mixed. The right hand side represents products after mixing. One can see that the strong acid $La^{+3}$ with the strong base $OH^-$, are joined together because it makes a strong acid and base combination. The $Br^-$is driven from the $La^{+3}$ and thus it is complexed with $H^+$, forming hydrobromic acid.

The reaction of TlBr with water following the scheme:

$$[Tl^+,Br^-]+[H^+, OH^-]\rightarrow[Tl^+, Br^-]+[H^+, OH^-].$$

In this case, $Tl^+$ and $Br^-$ are favored because they are a combination of soft-soft acid and base. While the $H^+$ and $OH^-$ are hard acid and base combination. The TlBr is a covalent compound and will dissolve in covalent solvents.

Therefore, in the case of $LaBr_3$, the hard acid $La^{+3}$ "seeks" out $OH^-$, resulting in a high reactivity in water. In contrast, TlBr (soft-soft) does not "seek" water (and vice versa). The result is a low degree of interaction, including solubility with water.

In the examples given above in this disclosure, the addition of TlBr as a co-dopant or in stoichiometric amounts reduces the hygroscopicity of the $LaBr_3$.

A further aspect of the present disclosure relates to a method of making scintillator materials of the above-mentioned compositions. In one example, high-purity starting compounds (such as $LaBr_3$ and TlBr) are mixed and melted to synthesize a compound of the desired composition of the scintillator material. A single crystal of the scintillator material is then grown from the synthesized compound by the Bridgman method (or Vertical Gradient Freeze (VGF) method), in which a sealed ampoule containing the synthesized compound is transported from a hot zone to a cold zone through a controlled temperature gradient at a controlled speed to form a single-crystalline scintillator from molten synthesized compound.

Thus, rare-earth metal halide scintillation materials with improved moisture resistance, density and/or light output can be made with the addition of group-13 elements such as Tl. Because many embodiments of the invention can be made without departing from the spirit and scope of the invention, the invention resides in the claims hereinafter appended.

We claim:

1. A material for radiation detection, comprising a scintillator material comprising a halide of a rare-earth metal; and a group-13 element, wherein the group-13 element forms covalent bonds with the halogen; the halide being $A'_{(1-x)}B'_xCa_{(1-y)}Eu_yC'_3$, $A'_{(1-x)}B'_xM'_2Br_{7(1-y)}C'_{7y}$, $A'_{(1-x)}B'_xM''_{(1-y)}Eu_yI_3$, $A'_{3(1-x)}B'_{3x}M''_{(1-y)}Eu_yI_5$, $A'_{(1-x)}B'_xM''_{2(1-y)}Eu_{2y}I_5$, $A'_{(1-x)}B'_xM'_2Cl_7$, $M'_{(1-x)}B'_xC'_3$, or any combination thereof, wherein:

A'=Li, Na, K, Rb, Cs or any combination thereof,

B'=B, Al, Ga, In, Tl or any combination thereof,

C'=Cl, Br, I or any combination thereof,

M' consist of Ce, Sc, Y, La, Lu, Gd, Pr, Tb, Yb, Nd or any combination thereof,

M" consists of Sr, Ca, Ba or any combination of thereof, where $0<x<1$, and where $0<y<1$.

2. The material of claim 1, wherein the group-13 element comprises thallium (Tl).

3. The material of claim 2, made from a rare-earth metal halide comprising $LaBr_3$, $LaCl_3$, $CeBr_3$, $CeCl_3$ or $LuI_3$ or a combination thereof, and a halide of a group-13 element in stoichiometric amounts.

4. The material of claim 3, made from a rare-earth metal halide comprises $LaBr_3$ and a halide of a group-13 element in stoichiometric amounts, and cerium (Ce).

5. The material of claim 2, wherein the rare-earth metal comprises at least two rare-earth metal elements.

6. The material of claim 1, made from a rare-earth metal halide comprising $LaBr_3$, $LaCl_3$, $CeBr_3$, $CeCl_3$, $LuI_3$ or a combination thereof, and a halide of a group-13 element in stoichiometric amounts.

7. The material of claim 1, wherein the rare-earth metal comprises at least two rare-earth metal elements.

8. The material of claim 1, wherein the halide defines a crystal lattice having a symmetry that is different from a symmetry of a crystal lattice defined by a halide of the rare-earth halide without the group-13 element.

9. The material of claim 1, wherein the halide is a stoichiometric halide of the formula $A'_{(1-x)}B'_xM'_2Br_{7(1-y)}C'_{7y}$, or $A'_{(1-x)}B'_xM'_2Cl_7$.

10. The material of claim 1, the scintillator material being a single crystal or polycrystal.

11. A radiation detector, comprising:

a material of claim 1 adapted to generate photons in response to an impinging radiation; and a photon detector optically coupled to the scintillator material, arranged to receive the photons generated by the scintillator material and adapted to generate an electrical signal indicative of the photon generation.

12. An imaging method, comprising:

using at least one radiation detector of claim 11 to receive radiation from a plurality of radiation sources distributed in an object to be imaged and generate a plurality of signals indicative of the received radiation; and based on the plurality of signals, deriving a spatial distribution of an attribute of the object.

13. The material of claim 1, wherein the halide is a stoichiometric halide.

14. The material of claim 13, wherein the halide is single crystalline or polycrystalline.

15. A method of making a scintillation material, comprising:

making a melt by heating a stoichiometric mixture of:

a rare-earth metal halide, and a salt of a group-13 element; and growing a single crystal from the melt, wherein the rare-earth metal halide and salt of a group-13 element are present in the stoichiometric mixture in a ratio to produce a single crystal of:

$A'_{(1-x)}B'_xCa_{(1-y)}Eu_yC'_3$, $A'_{(1-x)}B'_xM'_2Br_{7(1-y)}C'_{7y}$, $A'_{(1-x)}B'_xM''_{(1-y)}Eu_yI_3$, $A'_{3(1-x)}B'_{3x}M''_{(1-y)}Eu_yI_5$, $A'_{(1-x)}B'_xM''_{2(1-y)}Eu_{2y}I_5$, $A'_{(1-x)}B'_xM'_2Cl_7$, or any combination thereof, wherein:

A'=Li, Na, K, Rb, Cs or any combination thereof,

B'=B, Al, Ga, In, Tl or any combination thereof,

C'=Cl, Br, I or any combination thereof,

M' consist of Ce, Sc, Y, La, Lu, Gd, Pr, Tb, Yb, Nd or any combination thereof,

M" consists of Sr, Ca, Ba or any combination of thereof, where $0<x<1$, and where $0<y<1$.

16. The material of claim 15, wherein the rare-earth metal halide and a salt of a group-13 element are present in the stoichiometric mixture in a ratio to produce a single crystal of:

$A'_{(1-x)}B'_xM'_2Br_{7(1-y)}C'_{7y}$, $A'_{(1-x)}B'_xM'_2Cl_7$, or a combination thereof.

17. A material for radiation detection, comprising a rare-earth metal halide scintillator compound co-doped with a group-13 element where the group-13 element forms covalent bonds with the halogen of the halide; and where the halide is:

$A'_{(1-x)}B'_xCa_{(1-y)}Eu_yC'_3$, $A'_{(1-x)}B'_xM'_2Br_{7(1-y)}C'_{7y}$, $A'_{(1-x)}B'_xM''_{(1-y)}Eu_yI_3$,
$A'_{3(1-x)}B'_{3x}M''_{(1-y)}Eu_yI_5$,
$A'_{(1-x)}B'_xM''_{2(1-y)}Eu_{2y}I_5$,
$A'_{(1-x)}B'_xM'_2Cl_7$,
$M'_{(1-x)}B'_xC'_3$, or
any combination thereof,
wherein:
A'=Li, Na, K, Rb, Cs or any combination thereof,
B'=B, Al, Ga, In, Tl or any combination thereof,
C'=Cl, Br, I or any combination thereof,
M' consist of Ce, Sc, Y, La, Lu, Gd, Pr, Tb, Yb, Nd or any combination thereof,
M" consists of Sr, Ca, Ba or any combination of thereof,
where $0<x<1$, and where $0<y\leq 1$.

18. The material of claim 17, wherein the group-13 element comprises Tl.

19. The material of claim 18, made from a rare-earth metal halide comprising $LaBr_3$, $LaCl_3$, $CeBr_3$, $CeCl_3$, $LuI_3$ or a combination thereof, and a halide of a group-13 element in stoichiometric amounts.

20. The material of claim 17, wherein the rare-earth metal halide scintillator material comprises at least two rare-earth metal elements.

* * * * *